United States Patent [19]

Herborn et al.

[11] 4,412,731

[45] Nov. 1, 1983

[54] HIGH SPEED LOW TEMPERATURE DIAZO PROCESSOR

[75] Inventors: Peter E. Herborn, Menlo Park; Thomas T. Liu, Sunnyvale; Sze-Teh Young, San Jose, all of Calif.

[73] Assignee: NCR Corporation, Dayton, Ohio

[21] Appl. No.: 287,973

[22] Filed: Jul. 29, 1981

[51] Int. Cl.[3] ..... G03D 7/00

[52] U.S. Cl. ..... 354/299; 354/300; 34/37; 34/234

[58] Field of Search ..... 354/299, 300; 355/27, 355/100, 106; 34/36, 37, 234, 155; 430/150

[56] References Cited

U.S. PATENT DOCUMENTS

| | | | |
|---|---|---|---|
| 2,009,962 | 7/1935 | Kurten | 354/300 |
| 2,761,364 | 9/1956 | Cross | 354/300 |
| 3,147,687 | 9/1964 | Halden | 354/300 |
| 3,364,833 | 1/1968 | Mulvany | 354/300 |
| 3,411,906 | 11/1968 | Boone et al. | 430/150 |
| 3,435,751 | 4/1969 | Goodman et al. | 354/300 |
| 4,056,824 | 11/1977 | Iiyama et al. | 354/300 |
| 4,068,249 | 1/1978 | Degenhardt et al. | 354/300 |
| 4,099,868 | 7/1978 | Schroter et al. | 354/300 |
| 4,122,473 | 10/1978 | Ernohazy et al. | 354/299 |
| 4,135,814 | 1/1979 | Schroter | 354/300 |
| 4,150,992 | 4/1979 | Meadows et al. | 354/300 |
| 4,243,310 | 1/1981 | Herborn | 354/299 |
| 4,319,826 | 3/1982 | Bussche et al. | 354/300 |

FOREIGN PATENT DOCUMENTS

| | | | |
|---|---|---|---|
| 2659485 | 5/1978 | Fed. Rep. of Germany | 354/300 |
| 2656901 | 6/1978 | Fed. Rep. of Germany | 354/300 |

*Primary Examiner*—A. A. Mathews

*Attorney, Agent, or Firm*—J. T. Cavender; Wilbert Hawk, Jr.; George J. Muckenthaler

[57] ABSTRACT

An improved diazo film processing and developing system has warm-up and steady state heaters along with gravity loading of the film drive rollers and cast aluminum pre-heat and developing chambers. The chambers use resilient or leaf spring seals and a stainless steel aqueous ammonia separation chamber is contiguous and directly connected with the developing chamber for maintaining a temperature differential between the two chambers.

3 Claims, 6 Drawing Figures

HIGH SPEED LOW TEMPERATURE DIAZO PROCESSOR

BACKGROUND OF THE INVENTION

Diazo sensitized papers have been used for making duplicate copies from originals by means of contact printing and development of the exposed diazo paper in an aqueous ammonia vapor atmosphere. Diazo sensitized films have been used as a medium for making microfilm or microfiche masters and duplicates thereof because of the low cost, the high resolution and the increased speed of operation. Increasing demands are made on the film developing process, especially as to the speed of developing, so as to enable an efficient and high volume production of diazo film copies from a master film.

In some of the prior methods and apparatus which have been utilized for developing diazo film, it has been thought necessary that the development take place at higher pressure and higher temperature conditions as represented by prior knowledge of the design of previous processes of this type.

Representative prior art which is directed to film processing includes U.S. Pat. No. 2,009,962 issued to W. Kurten on July 30, 1935, U.S. Pat. No. 2,761,364 issued to E. L. Cross on Sept. 4, 1956, U.S. Pat. No. 3,147,687 issued to J. G. B. Halden on Sept. 8, 1964, U.S. Pat. No. 3,364,833 issued to R. B. Mulvaney on Jan. 23, 1968, and U.S. Pat. No. 3,411,906 issued to J. W. Boone et al. on Nov. 19, 1968.

Additionally, U.S. Pat. No. 3,435,751 issued to R. C. Goodman et al. on Apr. 1, 1969, discloses two body portions, spring seals and upper and lower heating elements. U.S. Pat. No. 4,056,824 issued to K. Iiyama et al. on Nov. 1, 1977, shows upper and lower heating elements in the rollers and also a heating element control.

U.S. Pat. No. 4,068,249 issued to K. Degenhardt et al. on Jan. 10, 1978, discloses spring seals and two body portions, U.S. Pat. No. 4,099,868 issued to H. Schroter et al. on July 11, 1978, discloses an evaporator chamber and a developing chamber connected with a tubing element, U.S. Pat. No. 4,122,473, issued to S. Ernohazy on Oct. 24, 1978 discloses a device for eliminating gaseous developer residue waste in an ammonia type diazo copying machine, and U.S. Pat. No. 4,135,814 issued to H. Schroter et al. on Jan. 23, 1979, shows a vaporizer cavity and a developing chamber with thermal control means.

Further, U.S. Pat. No. 4,150,992 issued to J. W. Meadows et al. on Apr. 24, 1979 discloses a high speed, low temperature and pressure diazo film processing method which uses two body portions with heating elements and a heating control, and U.S. Pat. No. 4,255,037 issued to J. W. Meadows et al. on Mar. 10, 1981 discloses high speed, low temperature and pressure diazo processing apparatus which uses two body portions with heating elements and heating control.

U.S. Pat. No. 4,243,310 issued to P. E. Herborn on Jan. 6, 1981 discloses pre-heat and developing chambers along with thermal control means in the nature of a heat-resistant spacer element connecting the developing chamber and the ammonia separation chamber.

Still further, German Document Nos. DT2656901 and DE2659485 disclose developing units for Diazo copying with external evaporators.

The above patents disclose processing methods and apparatus which include a number of advantageous features, however, it is desirable to operate the processor at higher speeds and at temperatures which are lower than are required for certain types of film. Certain state of the art diazo film processors require about 15 minutes to attain operating temperatures and process approximately 1500 microfiche per hour in an environment where the temperature of the film is about 180° F. Additionally, it is desirable that the injection method for introducing the aqueous ammonia into the atmosphere and vicinity of the developing chamber be such as to precisely and completely develop the film without defects or moisture spots on the film which may interfere with reading of the data which is present on the film.

SUMMARY OF THE INVENTION

The present invention relates to film duplicators and more particularly, to a diazo film developing processor for compact, efficient and easy-to-operate apparatus at high volume film output. The processor is a high speed, low temperature, zero pressure and low aqueous ammonia consumption diazo processing apparatus wherein the diazo film passes through a pre-heat chamber of the processor and is then developed in a heated ammonia vapor environment. The film is developed in ammonia vapor at a pressure which does not substantially exceed atmospheric pressure in that the developing pressure may be only slightly higher than atmospheric pressure by an amount no more than that required to introduce the vapor into the developing chamber. The low pressure ammonia vapor is combined with a relatively low range of operating temperatures which in the preferred embodiment are in the area of 168° F.–172° F. and are provided in a manner to lower the cost of heating the particular parts and to avoid damage to the film as it passes through the developing chamber. Additionally, the heater arrangement enables the attainment of operating temperatures within 10 minutes and the system can process approximately 2000 microfiche per hour.

The diazo film is caused to be moved into a pre-heat chamber to condition the film emulsion and the film is then transferred into a developing chamber which includes a contiguous cavity or trough portion at the entrance side of and directly connected with the developing chamber for carrying the ammonia vapor to the underside of the film for developing thereof. The aqueous or water-containing ammonia is introduced into the cavity portion of the developing chamber at a temperature which may be slightly above ambient temperature and the ammonia is caused to be vaporized by the difference in temperature between the entering ammonia and the temperature of the atmosphere surrounding the elements which carry the film through the developing chamber. The ammonia is separated from the water in the cavity portion of the developing chamber and the water is drained off in suitable manner.

The body of the film processor is made of two pieces of cast aluminum to provide for better heat transfer and more uniform temperature distribution along the path of the diazo film. The cavity portion of the developing chamber or that portion of the chamber wherein the ammonia is separated from the water is made of stainless steel and is directly connected to the processor body to provide the proper temperature differential between the atmosphere within the cavity and that of the developing chamber.

In accordance with the above discussion, the principal object of the present invention is to provide a high speed film processing system wherein the film is rapidly and uniformly developed within a few seconds.

An additional object of the present invention is to provide a film developing system for operation at lower temperatures to enable development of different types and/or kinds of diazo film.

Another object of the present invention is to provide a film developing system which includes distribution of the required heat from heater elements which are disposed to provide the proper heated ammonia vapor environment.

A further object of the present invention is to provide a water ammonia separation chamber of one material and a developing chamber of another material to enable a temperature differential between the incoming aqueous ammonia and the vaporized ammonia for developing the film.

Additional advantages and features of the present invention will become apparent and fully understood from a reading of the following specification taken together with the annexed drawing.

DESCRIPTION OF THE PREFERRED EMBODIMENT

Figure 1:
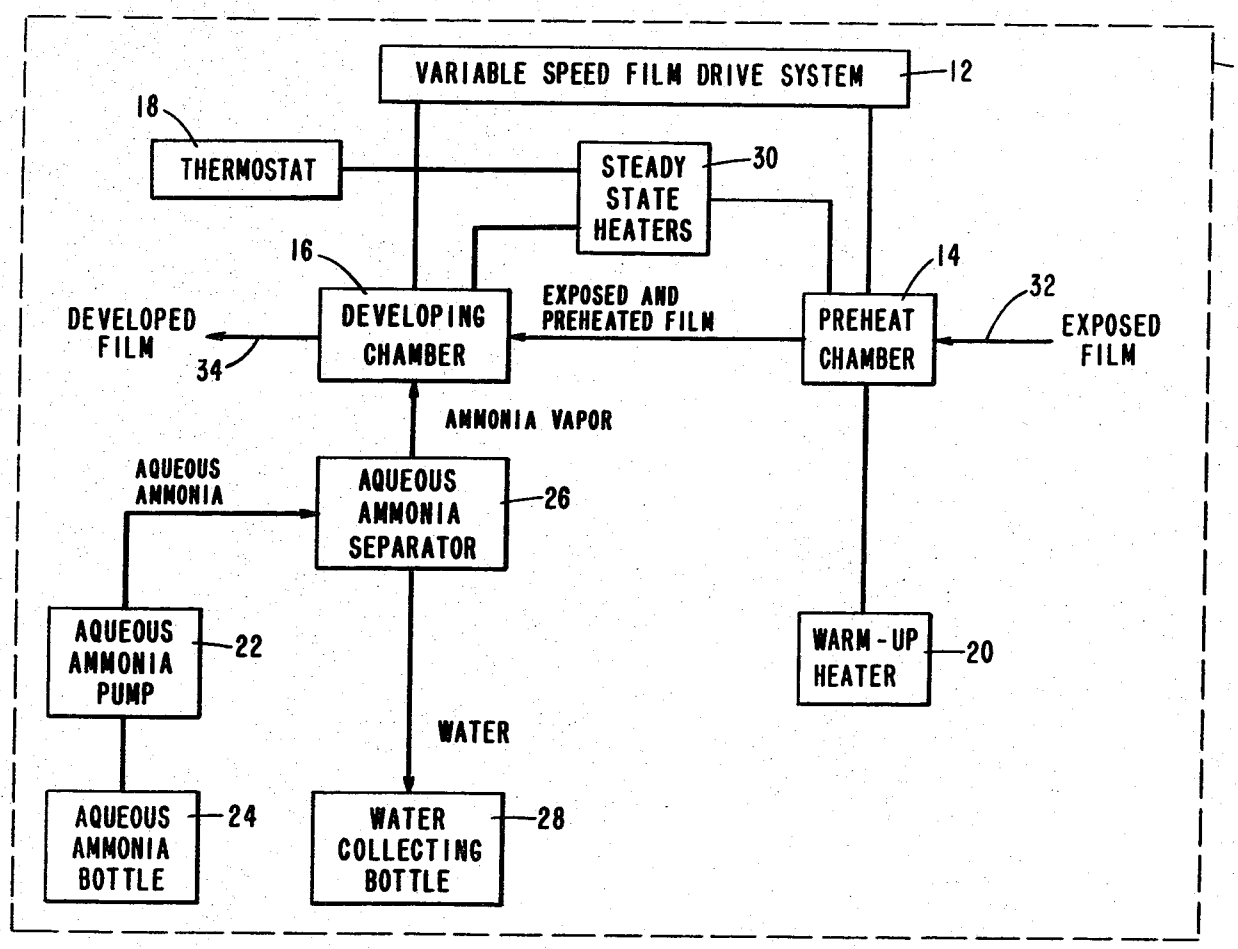
FIG. 1 is a block diagram of the major parts of the film processing system.

Referring now to the drawing, the processor of the present invention comprises a plurality of major parts, as shown in FIG. 1, and wherein the enclosure structure 10 and the various major parts of the processor are shown in block form representing the diazo film developing system. The major parts of the processor include a variable-speed film drive system 12 associated with a preheat chamber 14 and a developing chamber 16. The preheat chamber 14 includes a lower portion which is heated to the desired temperature from a warm-up heater assembly 20. An ammonia pump 22 is connected with and receives aqueous ammonia from a reservoir or bottle 24 and conveys the ammonia in aqueous or watery form into a separation chamber 26, which chamber is provided for separating out the water from the aqueous ammonia and permitting collection of the water in a bottle 28. A bank of steady state heaters 30 are provided for heating both the preheat chamber 14 and the developing chamber 16 under control of a thermostat 18. The path of the exposed film 32 is through the preheat chamber 14 and then through the developing chamber 16 from which the film emerges as developed film 34.

Figure 2:
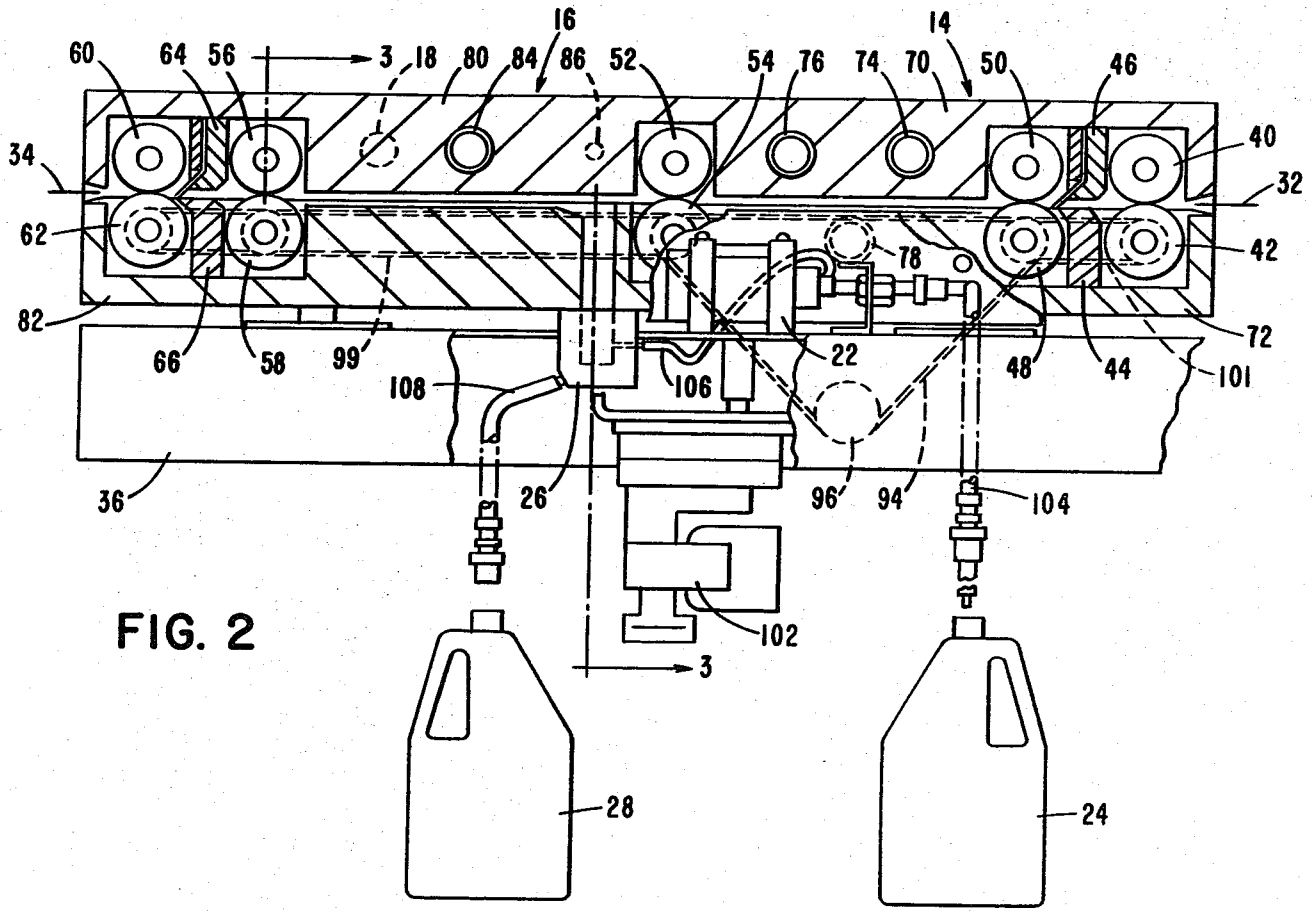
FIG. 2 is a front elevational view, partially in section, of a processor incorporating the subject matter of the present invention.
Figure 3:
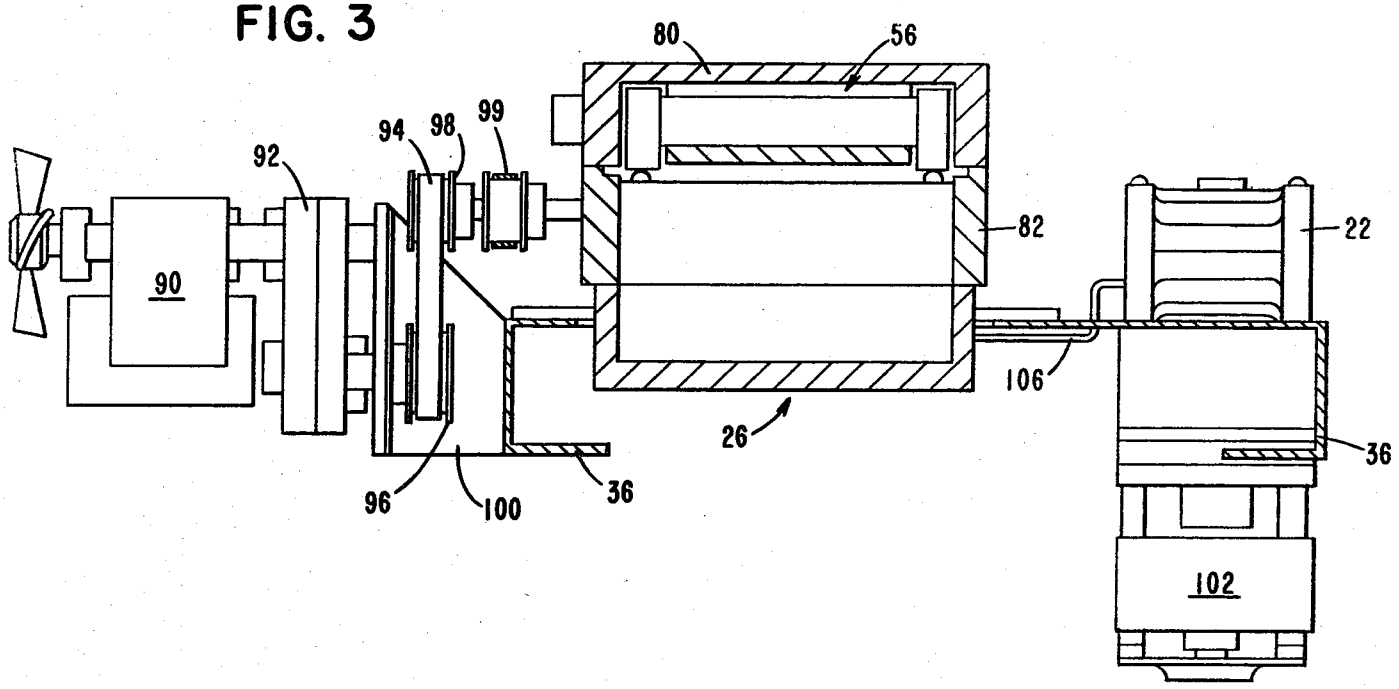
FIG. 3 is a side elevational view, partially in section, taken on the plane 3—3 of the processor shown in FIG. 2.

In FIG. 2 is shown a partial sectional and front elevational view of the processor and in FIG. 3 is shown a partial sectional and side elevational view thereof with certain of the parts being placed on both FIG. 2 and FIG. 3 for accommodation on the drawing. A base assembly 36 provides support for the various parts of the processor and a cover assembly may be secured to the top of the unit in suitable manner. A portion of a diazo film 32 is shown entering at the right side in FIG. 2 and a portion of the film 34, after developing thereof, is shown leaving the processor at the left side. The diazo film 32 is caused to be moved in a path between a roller assembly 40 and a roller assembly 42, through an entrance formed by means of opposed walls 44 and 46, between a second set of roller assemblies 48 and 50, and then into and through the preheat chamber 14. The film 32 is further caused to be moved by a set of roller assemblies 52 and 54 into and through the developing chamber 16, and finally, a pair of roller assemblies 56 and 58 convey the developed film 34 from the developing chamber 16 and through an exit, formed by opposed walls 64 and 66, after which a set of roller assemblies 60 and 62 drive the film 34 from the processing unit.

The preheat chamber 14 includes and upper plate or block portion 70 and a lower plate or block portion 72 which are formed to provide space for the several roller assemblies 40, 42, 48, 50, 52, 54 and which are spaced apart a distance sufficiently to enable passage of the film 32 as it is moved from the right to the left in FIG. 2. A pair of heaters 74 and 76, each in the form of a rod, are embedded in the upper block 70 for heating thereof and a heater 78 is embedded in the lower block 72. The individual heater 78 along with its thermal switch control provides the warm-up heater arrangement 20 (FIG. 1) for fast operation in the initial warming of the preheat chamber 14. One or more additional heaters may be used for the warm-up operation. The developing chamber 16 includes an upper plate or block portion 80 and a lower plate or block portion 82 which are formed to provide space for the roller assemblies 52, 54, 56, 58, 60, 62 and which are likewise spaced from each other a distance sufficiently to enable passage of the exposed film 32 and then the developed film 34. A heater 84 and a thermistor 86, along with heaters 74 and 76, provide the steady state heater arrangement 30 (FIG. 1) and are associated with the preheat chamber 14 and with the developing chamber 16 so as to maintain a desired temperature in the developing chamber 16 and also to control the amount of heat being conducted to the aqueous ammonia separation chamber 26. The thermostat 18 is preferably located in a suitable location in the developing chamber 16 for controlling the operation of the steady state heaters 74, 76 and 84. The block portions 70, 72, 80 and 82 are preferably made of cast aluminum in the form of a single upper block and a single lower block to reduce machining operations and to provide for better heat transfer and more uniform temperature distribution. Of course, it may be desirable to split the single upper block and the single lower block at roller assemblies 52, 54 to enable use of smaller parts. The two groups of heaters provide for fast warm up of the two chambers with a minimum amount of heater cycling. While the several heaters are rated at 250 watts, the warm up heater 78 may be of higher wattage than the steady state heaters 74, 76 and 84 and the thermostat 18 cuts out the warm up heater at a temperature below the steady state condition. The steady state heaters 74, 76, 80 have wattages for closely matching the steady operating conditions and by reason of their location, an upward temperature gradient is maintained during operation.

A drive motor 90, shown in FIG. 3, is provided to drive, through a reduction mechanism 92, the various sets of roller assemblies 40, 42, 48, 50, 52, 54, 56, 58, 60, 62 by means of a drive or timing belt 94 trained around a timing pulley 96 and around a pair of additional pulleys, as seen in the phantom showing in FIG. 2, there being one pulley 98 shown in FIG. 3 all in a manner and arrangement for driving or traveling in a direction so as to cause the diazo film 32 to be moved from right to left in FIG. 2. A belt 99 is provided to be trained around pulleys for driving roller assemblies 56, 58, 60 and 62 and a belt 101 is provided for driving roller assemblies 40 and 42. Of course, different belt and pulley arrangements may be used for driving the several roller assemblies in the counterclockwise direction (FIG. 2). The drive system is supported by means of suitable bracketing structure 100 from the base assembly 36.

A motor 102 is also supported from the base assembly 36 and is connected to drive the ammonia pump 22 for the purpose of moving aqueous ammonia from the bottle 24 through tubing 104 to the pump. The ammonia is moved from the pump 22 to the separation chamber 26 through tubing 106 extending into one side of the chamber. A tube 108 has one end thereof disposed for draining the separation chamber 26 of accumulated water and to deposit such water into the container or bottle 28.

Figure 4:
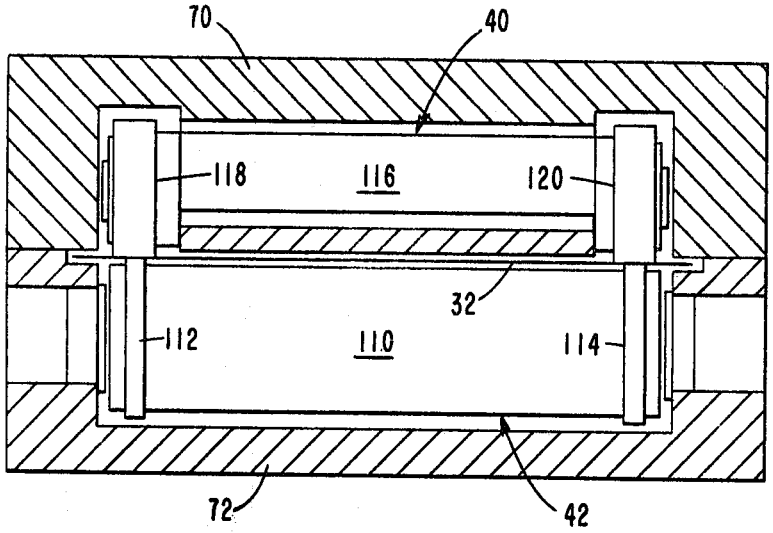
FIG. 4 is a sectional view showing the drive roller and idler roller assembly.

In FIG. 4 is shown an enlarged view of a drive roller and idler roller assembly which is made up of the drive roller assembly 42 and the idler roller assembly 40 contained within block portions 70 and 72. The drive roller assembly 42 is connected to the drive mechanism shown in FIGS. 2 and 3 and includes an aluminum roller 110 having O-rings 112 and 114 installed on the roller at a center-to-center distance slightly less than the width of the film 32. The idler roller assembly 40 includes a stainless steel shaft 116 which has ball bearings 118 and 120 thereon at a center-to-center distance mating with the O-rings 112 and 114. The rings 112 and 114 are made of silicon rubber and are square in cross-section to provide additional and better traction and also longer service. The silicone rubber has the advantages of being resistant to corrosion and high temperature and the stainless steel is used for reasons of its high density and also for its resistance to corrosion. The heavy steel shaft provides sufficient pressure, without the need for spring or like bias means, on the O-rings 112 and 114 of the drive roller assembly 42.

Figure 5:
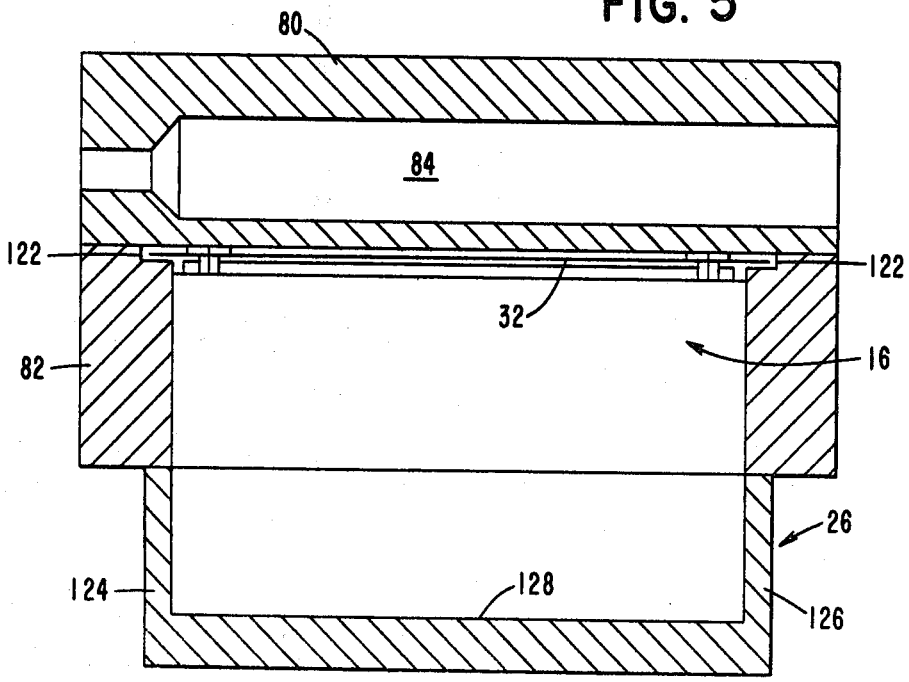
FIG. 5 is a sectional view showing the processor body along with the separation chamber.

In FIG. 5 is shown an enlarged sectional view through the developing chamber 16 and through the separation chamber 26 which is located at the entrance end of the developing chamber and is in the shape of a deep cavity or trough to accommodate the temperature differential between the aqueous ammonia being introduced into the lower chamber 26 and the upper part of the developing chamber 16. The developing chamber includes the upper cast aluminum plate or block portion 80 of generally rectangular construction along the plane of viewing, and the lower cast aluminum plate or block portion 82 is also of generally rectangular construction except for the trough area connecting with the separation chamber 26 so as to provide a closed container for the developing portion of the processor. The lower block portion 82 also includes a cut out portion 122 at each side thereof to accommodate the film 32. The separation chamber 26 includes the side or end walls 124 and 126 and a lower base 128 and which forms an elongated cavity at the entrance end of the developing chamber 16 for enabling the vaporized ammonia to rise and thereby make contact with the emulsion side of the diazo film 32.

Figure 6:
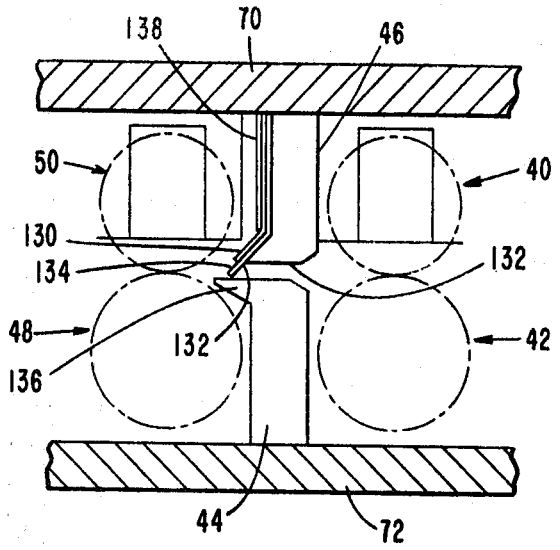
FIG. 6 is a view of the seal assembly at the ends of the processor.

FIG. 6 shows an enlarged view of the drive roller 42 and idler roller 40 assembly at the entrance end of the processor in an arrangement to prevent ammonia vapor from escaping to the atmosphere. An end seal structure includes a leaf spring 130 formed along a lip portion 132 of the wall 46 to maintain a sheet of silicone rubber 134 against the lip portion 132 and in contact with a lip portion 136 of the wall 44. The leaf spring 130 is secured to the wall 46 by a plate or like member 138. The silicone rubber is used in the end seal structure for reasons of its resistance to corrosion and to high temperature.

In the operation of the processor, the diazo film 32, in an exposed and cut-to-length condition and with the emulsion side of the film disposed in a downward direction, is caused to be removed into the preheating chamber 14 by means of the O-rings 112 and 114 on the roller 110 of the drive roller assemblies 42 and 48 cooperating with the idler roller assemblies 40 and 50. The emulsion on the film is preconditioned by the elevated temperature through heating the blocks 70 and 72 by use of the heaters 74, 76 and 78 and which heat is caused to be moved by thermal conduction to the surface of the passageway occupied by the film 32. The middle roller assemblies 52 and 54 then transport the conditioned film 32 into the developing chamber 16 where the emulsion on the lower side of the film is exposed to and contacted by the ammonia vapors which react with the emulsion and thereby develop the film. The final roller assemblies 56, 58 and 60, 62 then convey the developed film 34 from the chamber 16 and onto a tray (not shown) on the side of the processor. In similar manner, as in the case of the first chamber 14, the heater 84 provides the desired heat in the developing chamber 16 to the elevated temperature in heating the upper block portion 80. The aluminum blocks 70 and 72 in the preheat chamber 14 and also the aluminum blocks 80 and 82 of the developing chamber 16 distribute the heat by thermal conduction. The thermistor 86 is placed in the upper block portion 80 and above the separating chamber 26 to provide a reasonably constant temperature for developing the exposed film 32. The aluminum blocks 70, 72, 80 and 82 in each of the chambers are coated with suitable thermoplastic material on the surfaces which are adjacent the film path to provide for smooth passage of the film therealong.

The aqueous or watery ammonia is introduced or pumped into the separation chamber 26 at room temperature and with a certain amount of heat being transferred from the block 80 to the walls of the separation chamber 26, the separation chamber is caused to be heated a desired amount which is substantially lower than the temperature of the upper chamber 16. The arrangement of the separation chamber 26 and the developing chamber 16 is a controlling factor in determining the desired temperature differential between the two chambers 16 and 26 and wherein the separation chamber 26 is made of stainless steel to provide and maintain a temperature differential from that of the aluminum developing chamber 16. As the aqueous ammonia is caused to be introduced at substantially ambient temperature, or approximately 70° F., into the separation chamber 26 and which chamber is at a temperature slightly above such ambient temperature, the ammonia flows over the heated surface of the separation chamber 26 and separates from the water in extremely fast manner and the ammonia vapor spreads rapidly and rises by reason of the elevated temperature of the developing chamber 16. The higher temperature environment at the top of the separating chamber 26 is saturated with ammonia vapor in a uniform manner so that when the film passes across the open chamber 26 at the front end of the developing chamber 16 the contact with the emulsion on the underside causes development of the film within a period of one to two seconds. The water is accumulated and drains off after the ammonia has separated and because the water is only in the cooler portion of the chamber 26, the water does not enter and does not appear on the surfaces in the developing chamber 16. When the aqueous ammonia is injected or introduced into the separation chamber or trough 26 below the film developing area, the ammonia separates from the water in the simple flow-through process of aqueous ammonia separation and the ammonia vapors rise with the warm air to contact the preheated emulsion on the underside of the diazo film 32 for developing thereof as the film passes over the open chamber 26. In this manner, the water is prevented from contacting the film and thus the film is free of water spots.

In actual operation, it was seen that the optimum temperature in the developing chamber 16 was about 170° F. and that a direct drive ammonia pump 22 provided the correct amount of ammonia vapor for superior development of the film while consuming a minimum amount of aqueous ammonia. The stainless steel construction of the separation chamber 26 and its direct connection with the cast aluminum block 82 of the developing chamber 16 along with the lower heat conducting property of stainless steel as compared with cast aluminum proved in the final design to uniformly control the heat flow from the block 80 in the developing chamber 16 to the separation chamber 26 so as to provide the optimum temperature differential between the developing area 16 and the bottom of the trough 26. Typical values for the two metals are coefficients of thermal expansion of 0.094 for the cast aluminum and 0.073 for the stainless steel. Thermal conductivity properties are in the range of 115–120 for the aluminum and 24–26 for the stainless steel. Additionally, the processor can be operated at various speeds by changing pulleys and belts or by varying the drive motor speed along with the ammonia feed rate and the temperature.

It is thus seen that herein shown and described is a diazo film developing system including method and apparatus for developing diazo film in a high-speed, low temperature, substantially zero pressure, and low aqueous ammonia consumption processor which is extremely reliable and efficient for developing the diazo film. The system requires about ten minutes to warm up to the operating temperature and processes about 2,000 microfiches per hour at a film temperature of 170° F. The present invention enables the accomplishment of the objects and advantages mentioned above, and while a preferred embodiment of the invention has been disclosed herein, variations thereof may occur to those skilled in the art. It is contemplated that all such variations and modifications not departing from the spirit and scope of the invention hereof are to be construed in accordance with the following claims.

We claim:

1. A diazo film developing system comprising a first chamber made of aluminum and having a heater for preheating said film, a second chamber made of aluminum and positioned for developing said preheated film, means for heating said second chamber and maintaining a desired operating temperature therein, means for moving said film through said first and said second chambers, and a third chamber directly connected with said second chamber for receiving aqueous ammonia in controlled manner, said third chamber comprising an elongated trough contiguous with and opening into said second chamber and disposed at one end thereof and being entirely of stainless steel material having a lower heat-conducting property than the aluminum material of said second chamber for maintaining a temperature differential therebetween, said elongated trough having a temperature lower than the temperature of said second chamber whereby said aqueous ammonia is vaporized and the ammonia vapor rises from the elongated trough and contacts the emulsion of said film moving through the second chamber, the temperature differential causing the ammonia to separate from the water prior to contact with said film.

2. Apparatus for developing diazo film comprising means for preheating said diazo film, means defining a developing chamber made of aluminum and including first and second, spaced apart, substantially parallel surfaces to provide a path for said diazo film, a separation chamber comprising an elongated cavity at one end of said developing chamber, means for maintaining said developing chamber at a predetermined operating temperature, opposed roller assembly means positioned at the ends of said developing chamber for moving said diazo film into and through said developing chamber with the emulsion side of said diazo film adjacent one of said surfaces, and means for introducing aqueous ammonia into the elongated cavity, said elongated cavity being contiguous with and opening into said developing chamber and made entirely of stainless steel material having a lower heat conducting property than the aluminum material of said developing chamber for maintaining a temperature differential therebetween, the temperature of said elongated cavity being lower than the operating temperature of the film path through said developing chamber to enable vaporization of said aqueous ammonia whereby ammonia vapor is separated from the water and the vapor rises from the elongated cavity and contacts the emulsion side of said diazo film moving through the developing chamber.

3. In a diazo film processor having a first chamber for preheating said film and a second chamber for developing said film, means for heating said second chamber to and maintaining a predetermined temperature therein, and opposed roller assembly means for moving said diazo film through said chambers, the improvement comprising means defining an elongated separation trough directly connected and contiguous with for opening into one end of said second chamber and connected for receiving aqueous ammonia, said second chamber being made of aluminum material having a predetermined heat conducting property and said elongated separation trough being made entirely of stainless steel material having a lower heat conducting property for maintaining a temperature differential therebetween for enabling said aqueous ammonia to be separated from the water and wherein the vaporized ammonia rises from the elongated separation trough and contacts the emulsion of said film moving through the second chamber.

* * * * *